United States Patent [19]

Ariizumi et al.

[11] Patent Number: 4,875,500

[45] **Date of Patent: * Oct. 24, 1989**

[54] DIAPHRAGM TYPE OF PILOT OPERATED DIRECTIONAL CONTROL VALVE

[75] Inventors: Ryozo Ariizumi, Urawa; Masakuni Kainuma; Shoji Suda, both of Ohmiya; Toshikazu Aoki, Kawagoe; Takashi Ejiri; Masao Kojima, both of Tokyo; Mitsunori Hoshi, Ohmiya, all of Japan

[73] Assignee: Fujikura Rubber Ltd., Tokyo, Japan

[ * ] Notice: The portion of the term of this patent subsequent to May 17, 2005 has been disclaimed.

[21] Appl. No.: 169,236

[22] Filed: Mar. 16, 1988

Related U.S. Application Data

[62] Division of Ser. No. 50,110, May 15, 1987, Pat. No. 4,744,388.

[30] Foreign Application Priority Data

May 19, 1986 [JP] Japan ..... 61-114360
May 28, 1986 [JP] Japan ..... 61-80863
Sep. 30, 1986 [JP] Japan ..... 61-232933

[51] Int. Cl.[4] ..... F15B 13/042

[52] U.S. Cl. ..... 137/596.18; 137/596.14; 137/596.15

[58] Field of Search ..... 251/61.1; 137/596.14, 137/596.15, 596.16, 596.18

[56] References Cited

U.S. PATENT DOCUMENTS

| | | | |
|---|---|---|---|
| 2,427,441 | 9/1947 | Butts | 251/61.1 X |
| 3,080,887 | 3/1963 | Brandenberg | 137/596.14 |
| 4,046,159 | 9/1977 | Pegourie | 137/269 |
| 4,221,361 | 9/1980 | Weingarten | 251/61.1 X |
| 4,516,605 | 5/1985 | Taplin | 137/596.15 |
| 4,744,388 | 5/1988 | Ariizumi et al. | 137/596.14 |

*Primary Examiner*—Gerald A. Michalsky
*Attorney, Agent, or Firm*—Beveridge, DeGrandi & Weilacher

[57] ABSTRACT

A pilot operated directional control valve having a diaphragm held between a passage block which has a feeding port, at least one loading port and at least one discharge port, and an opposed control block which has pilot pressure passages. The ports of the passage block open into the end face of the passage block adjacent to the control block through respective fluid passages. The pilot pressure is exerted on the diaphragm by the pilot pressure passages to control the fluid connection between the ports of the passage block. The fluid passages are located in a concentric arrangement.

The diaphragm has a center valve portion with an annular valve portion therearound. The two valve portions can be independently controlled by the pilot pressure acting thereon to control the fluid connection between the two adjacent fluid passages.

2 Claims, 11 Drawing Sheets

DIAPHRAGM TYPE OF PILOT OPERATED DIRECTIONAL CONTROL VALVE

This is a division of application Ser. No. 050,110 filed May 15, 1987, now U.S. Pat. No. 4,744,388.

BACKGROUND OF THE INVENTION

1. Field of the Invention

The present invention relates to a pilot operated directional control valve in which a pilot pressure acts on a diaphragm to control a fluid connection between valve ports.

2. Description of Related Art

U.S. Pat. No. 4,516,605 discloses a basic construction of a known pilot operated directional control valve which has a diaphragm on which the pilot pressure acts, as shown in FIGS. 9–13.

In FIGS. 9–13, the pilot operated directional control valve has a diaphragm 11 which also serves as a gasket and which is located between a passage block 20 and a control block 10. The passage block 20 has therein a single feeding port 22 which is connected to a pressurized fluid source (pneumatic pump) P, a pair of loading ports 25, and a pair of discharge ports 27.

The feeding port 22 has a pair of branch passages 23 connected thereto and bifurcated therefrom. The branch passages 23 are connected to a pair of annular passages 24. The loading ports 25 open into the annular passages 24 at the center portions thereof, and are connected to annular passages 26. The discharge ports 27 open into the annular passages 26 at the center portions of the latter. The annular passages 24, the loading ports 25, the annular passages 26 and the discharge ports 27 open into the end face of the passage block 20 adjacent to the control block 10 and face the diaphragm 11. The loading ports 25 are connected to an actuator A. The discharge ports 27 open into the atmosphere.

The actuator A shown in FIGS. 9–13 is a pneumatic cylinder device which has cylinder chambers S1 and S2 which are separated from each other by a piston P1 and which are connected to the respective loading ports 25.

The end portions of the wall which defines and surrounds the loading ports 25 and the discharge ports 27 form on the control block side valve seats 25*s* and 27*s* on which the diaphragm 11 is selectively seated. The numeral 12 designates grids which prevent the diaphragm 11 from deforming to bend into the loading ports 25 (and the discharge ports 27) due to a pressure difference across the diaphragm 11.

The control block 10 has therein pilot pressure passages 31 and 32 which open into the center portions of the diaphragm cavities corresponding to the loading ports 25 and the discharge ports 27, respectively. The diaphragm 11 deforms so that it is bent toward the passage block 20 when the diaphragm 11 is subject to a predetermined pilot pressure p through the pilot pressure passages 31 and 32 which are connected to a pilot pressure control device 33. Namely, when the pilot pressure p acts in the pilot pressure passages 31, the diaphragm 11 deforms so that the fluid connection between the feeding port 22 and the loading ports 25 is broken and when the pilot pressure p is exerted in the pilot pressure passages 32, the diaphragm 11 deforms so that the fluid connection between the loading port 25 and the discharge ports 27 is broken. Thus, the fluid connection between the ports can be switched by controlling the feed of pilot pressure into the pilot pressure passages 31 and 32, so that the feed of the working fluid to the actuator A can be controlled, as shown in FIGS. 9–12.

The passages and the ports, shown with the references p are under the pilot pressure p, and the ports and the passages without the reference p open in the atmosphere. In FIG. 9, the piston P1 moves in the right hand direction, since the working fluid (air) is fed from the pneumatic pump P into the cylinder chamber S1 through the feeding port 22, the left branch passage 23 and the loading port 25 on the left side. On the other hand, in FIG. 10, the piston P1 moves in the left direction, since the fluid connection is established between the right loading port 25 and the pneumatic pump P. In FIGS. 11 and 12, the piston P1 does not move in either direction.

According to the pilot operated directional control valve as mentioned above and shown in FIGS. 9–12, thanks to the absence of a sliding part, there are many advantages that no lublication is necessary, a large flow of working fluid (air) can be used, and no precise machining needs, etc.

On the contrary, in the pilot operated directional control valve mentioned above, it is necessary to move the diaphragm 11 at two portions thereof located at the center portions of the loading ports 25, and at the discharge ports 27 for each of two pairs of passages consisting of the feeding port 22 (which is common to the two pairs), the loading ports 25, and the discharge ports 27, and accordingly the directional control valve becomes large and complex.

In addition to the foregoing, it has been experimentally found by endurance tests of the directional control valve of the prior art mentioned above that the endurance (or seal effect) of the diaphragm was insufficient.

The inventors analyze the cause of such an insufficient endurance of the diaphragm as follows.

Namely, the diaphragm 11 comes into contact with and separates from the annular valve seats 25*s* and 27*s* and the grids 12 located in the annular valve seats, in accordance with the control of the pilot pressure, as mentioned above. The contact between the diaphragm 11 and the grids 12 occur substantially always at the same contact portions of the diaphragm. This restricted contacts cause marks of grids 12 to be made on the diaphragm 11, resulting in a decrease of endurance and elasticity of the diaphragm 11. Furthermore, since the annular seats 25*s* and 27*s* are substantially; flush with the grids 12, the grids 12 restricts the smooth and elastic deformation of the diaphragm 11, resulting in an insufficient sealing effect and endurance.

The primary object of the present invention is, therefore, to provide a compact and simple pilot operated directional control valve which can eliminate the drawbacks mentioned above.

Another object of the present invention is to provide a pilot operated directional control valve which has increased endurance and sealing effect.

Still another object of the present invention is to provide a directional control valve which can be selectively used as a three-way valve or a two-way valve by replacing an element of the valve.

In order to achieve the objects mentioned above, according to the present invention, the improvement is focused on the arrangement of the valve ports and the passages (feeding port, loading ports, and discharge ports, etc.) provided in the passage block. Namely, in the present invention, the valve features the ports connecting passages which open into the diaphragm mating end face of the passage block in a concentric arrangement and also the diaphragm that opens and closes said concentric passages at the center portion and at the concentric annular portion respectively.

The diaphragm has a center valve portion and a concentric annular valve portion surrounding the center valve portion, so that the fluid connection between the two adjacent passages can be independently controlled by the center valve portion and the circumferential annular valve portion.

With this arrangement, the directional control valve can be made small and compact. Namely, it is possible to realize small and simple passage block and control block and a simple and small diaphragm, resulting in an easy assembly of a directional control valve. Furthermore, with the arrangement of the present invention mentioned above, since the diameter of the outer fluid passage in cross section can be increased, the slight displacement of the diaphragm causes a large sectional area of the fluid passage, thus resulting in a large flow of the working fluid.

In addition to the foregoing, to increase the endurance of the diaphragm, according to one aspect of the present invention, the diaphragm is provided with an annular bead which is opposed to an annular valve seat provided on the end face of the passage block that is located adjacent to the control block and which comes into contact with and separates from the valve seat due to the pilot pressure acting on the diaphragm. The annular bead of the diaphragm can be pressed against the valve seat with a high contact pressure, so that a high seal effect can be ensured.

Also, according to another aspect of the present invention, means for preventing an excess deformation of the diaphragm is provided. The preventing means can be embodied by a column which is provided in the passage block and which has an end face slightly recessed from the end face of the passage block adjacent to the control block, so that the deformation of the diaphragm is restricted when the diaphragm comes into abutment with the end face of the column.

According to still another aspect of the present invention, the passage block is composed of a main block and another block element which is integrally connected to the main block. Another block element can be used as a discharge block which has a discharge port or an end plate.

By the selective use of the discharge block or the end plate, the directional control valve of the present invention can be selectively used as a threeway directional control valve or a two-way directional control valve. Namely, according to a different aspect of the present invention, there is provided a diaphragm type of pilot operated directional control valve, comprising a pair of opposed passage block and control block, and a diaphragm which is held between the passage and control blocks, said passage block being provided with ports which are connected to respective fluid passages which open into the end face of the passage block adjacent to the control block, said control block being provided with pilot pressure passages which are connected to a pilot pressure control device to exert the pilot pressure on the diaphragm, the fluid connection between the ports can be controlled by the control of the pilot pressure exerted on the diaphragm, wherein the passage block is composed of a main block and a discharge block with a discharge port or an end plate, said main block being provided with a feeding port and a loading port which open into the end face of the passage block adjacent to the control block through two concentric fluid passages, said passage block being provided with a third fluid passage which open into the end face of the passage block adjacent to the control block and which is concentric to the two fluid passages, said diaphragm having a center valve portion and an annular valve portion therearound, so that when the discharge block is connected to the main block, the discharge port of the discharge block can be connected to the third port of the passage block, and when the end plate is connected to the main block, the third port of the passage block can be closed by the end plate.

BRIEF DESCRIPTION OF THE DRAWINGS

The invention will be described below in detail with reference to the accompanying drawings, in which:

FIG. 8 is a sectional view taken along the line VIII–VIII in FIG. 7;

FIGS. 9 through 12 are sectional views of a known pilot operated directional control valve according to the prior art, shown in different operational positions;

DESCRIPTION OF PREFERRED EMBODIMENTS

Figure 1:
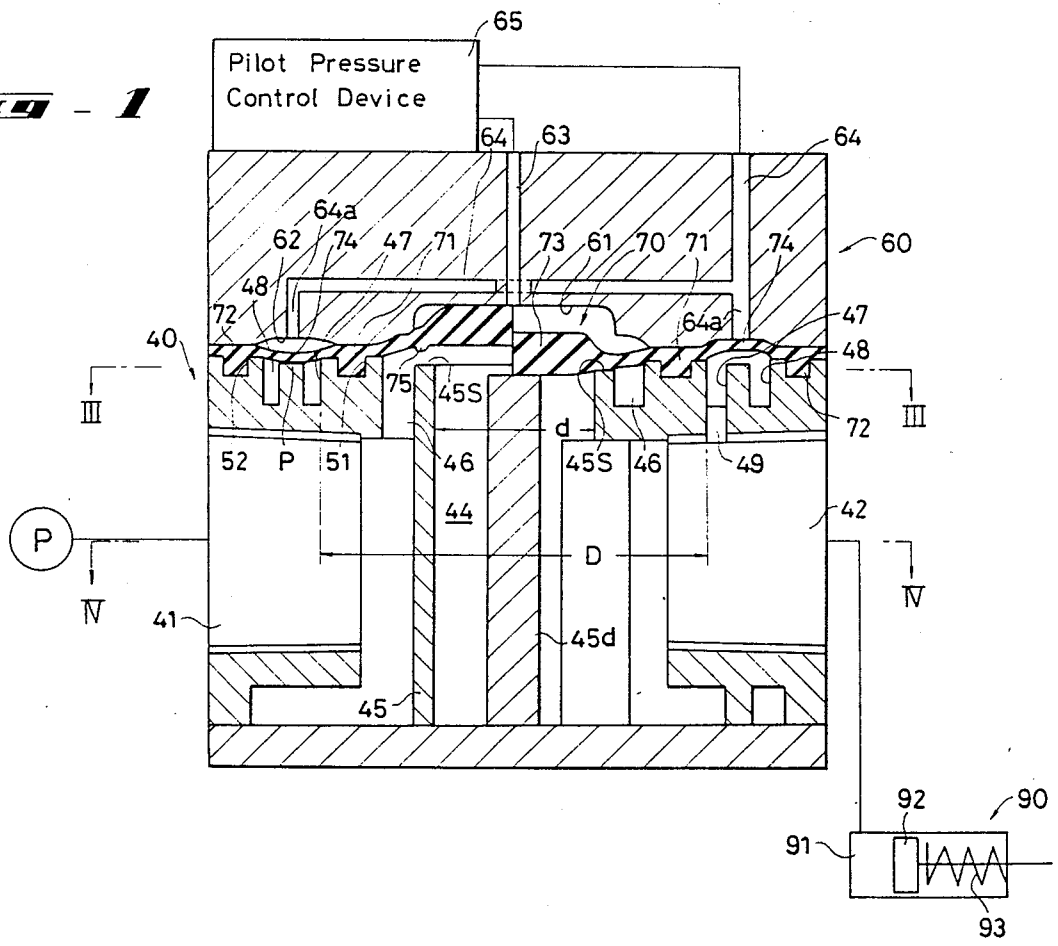
FIG.1 is a longitudinal view of a pilot operated directional control valve according to the present invention, shown in different valve positions on the right and left valves of the drawing.
Figure 2:
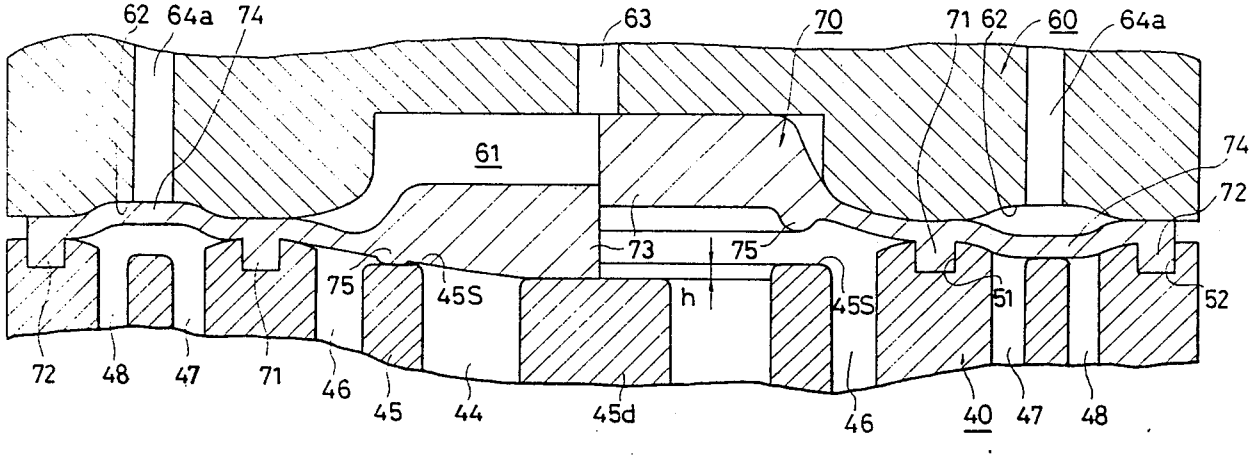
FIG. 2 is an enlarged sectional view of a diaphragm and surroundings thereof, shown in FIG. 1.

With reference to FIGS. 1–4, the passage block 40 has at least one feeding port 41, at least one loading port 42, and at least one discharge port 43, as a minimum unit of valve ports of a directional control valve. These ports extend toward the center portion of the square or rectangular section of the rectangular-parallelepiped passage block 40 from the three sides of the square or rectangular shape in cross section thereof, preferably in the same plane. The loading port 42 is directly connected to a center hole 44 of the passage block 40. An annular passage (feeding annular passage) 46 is formed to surround the center hole 44 through a separation wall 45, so that the annular passage 46 is connected to the feeding port 41. The separation wall 45 has an end face which is located adjacent to the control block 60 to form a valve seat 45s.

Figure 3:
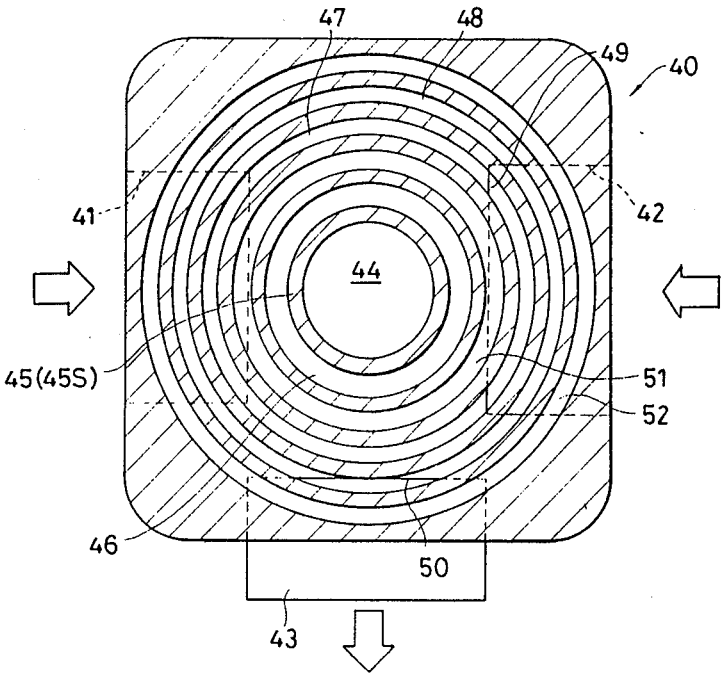
FIGS. 3 and 4 are sectional views taken along the lines III–III and IV–IV in FIG. 1.
Figure 4:
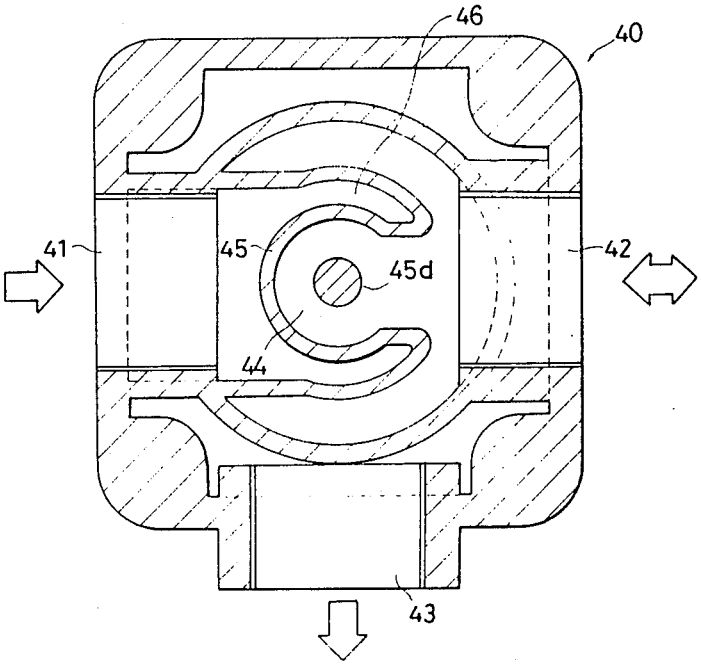
Figure 5:
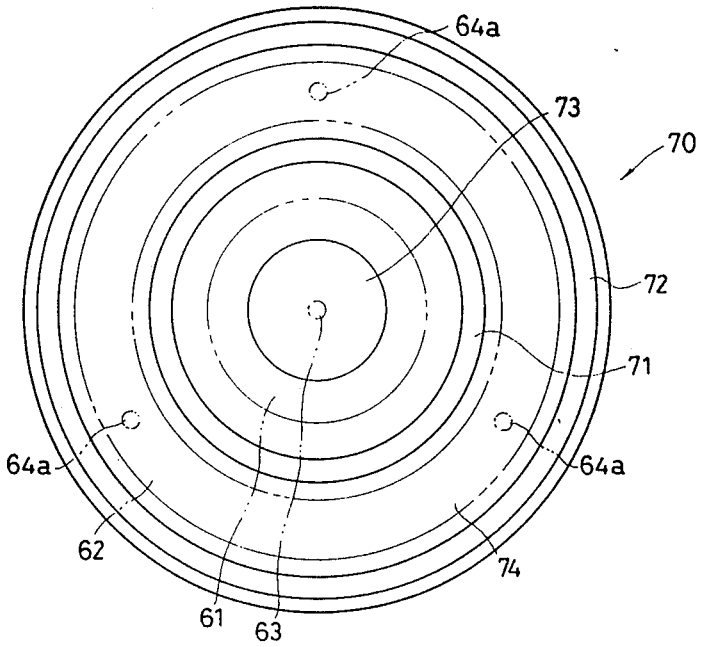
FIG. 5 is a plan view of a diaphragm for showing a center recess, annular recess and pilot pressure passages, formed in a control block.

On the end face of the passage block 40 adjacent to the control block 60 are formed a loading annular passage 47 and a discharging annular passage 48, both being concentric to the separation wall 45. The loading annular passage 47 is connected to the loading port 42 through a connection passage 49, and the discharging annular passage 48 is connected to the discharge port 43 through a connection passage 50 (FIG. 3). On the end face of the passage block 40 adjacent to the control block 60 are formed bead grooves 51 and 52 which receive threrein annular beads 71 and 72 provided on the diaphragm 70 and which are located between the annular passage 46 and the annular passage 47 and outside the annular passage 48, respectively. The bead grooves 51 and 52 are concentric to the separation wall 45 and the annular passages. The beads 71 and 72 are fitted in the corresponding bead grooves 51 and 52, respectively.

The diaphragm 70 has center circular valve portion 73 which has a larger thickness and an annular valve portion 74 therearound which is located between the annular beads 71 and 72, so that when the center valve portion 73 comes into contact with the valve seat 45s, the fluid connection between the feeding port 41 and the loading port 42 is broken. When the annular valve portion 74 comes into contact with the loading annular passage 47 and the discharging annular passage 48, the fluid connection between the loading port 42 and the discharge port 43 is broken.

The center valve portion 73 of the diaphragm 70 is formed with an annular bead 75 integral therewith which is opposed to the annular valve seat 45s and which has generally semicircular cross section.

The passage block 49 is provided with a column 45d integral therewith which comes into abutment with the center valve portion 73 of the diaphragm 70 to prevent the center valve portion 73 from excessively deforming. The abutment surface of the column 45d against the center portion of the center valve portion 73 of the diaphragm 70 is formed by a flat end face which is recessed by a distance h from the plane of the annular valve seat 45s, so that the center valve portion 73 of the diaphragm 70 can deform into the center hole 44 only by a displacement corresponding to the distance h.

The control block 60 has therein a center recess 61 and an annular recess 62 concentric thereto, corresponding to the center valve portion 73 and the annular valve portion 74, respectively. The center recess 61 and the annular recess 62 are connected to pilot pressure passages 63 and 64, respectively. The pilot pressure passage 63 opens into the center portion of the center recess 61, and the pilot pressure passage 64 has a plurality of branches 64a which are concentrically located at a predetermined angular distance and which open into the circumferential portion of the annular recess 62. The pilot pressure passages 63 and 64 are connected to the pilot pressure control device 65 to control the feed of the pilot pressure to the pilot pressure passages 63 and 64.

When the pilot pressure p is supplied to the pilot pressure passage 63 by the pilot pressure control device 65, the center valve portion 73 of the diphragm 70 is seated on the valve seat 45s to break the fluid connection between the feeding port 41 and the loading port 42. In this state, the contact pressure between the center portion 73 and the annular valve seat 45s is concentrated at the annular bead 75 projecting toward the annular valve seat 45s and at the annular valve seat 45s, and accordingly the contact pressure can be increased in comparison with the prior art in which no concentration of the contact pressure takes place, resulting in a high sealing effect.

Figure 9:
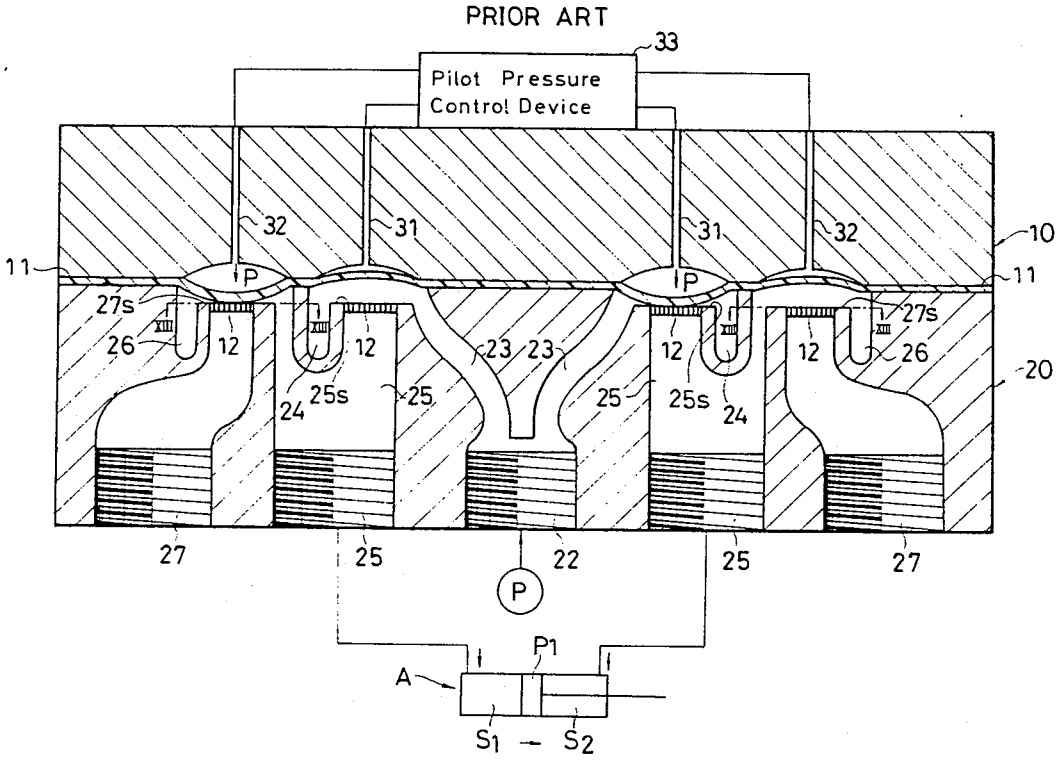
Fig. 9 PRIOR ART
Figure 11:
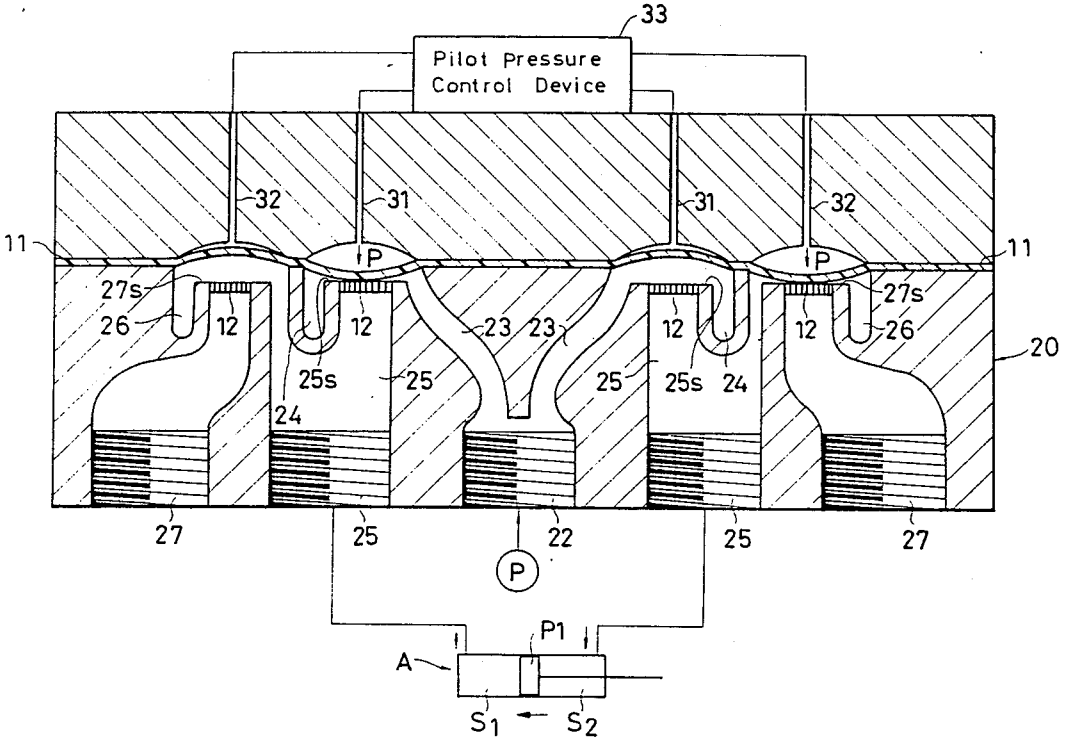
Fig. 11 PRIOR ART
Figure 11:
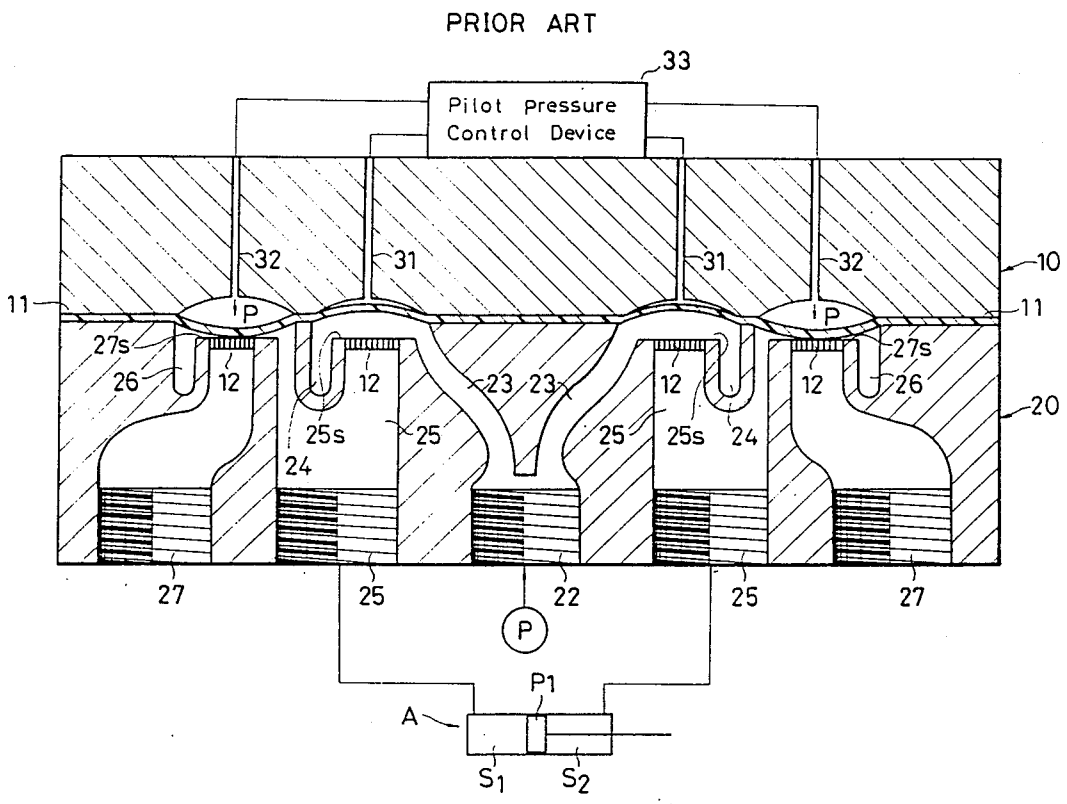
Fig. 11 PRIOR ART
Figure 12:
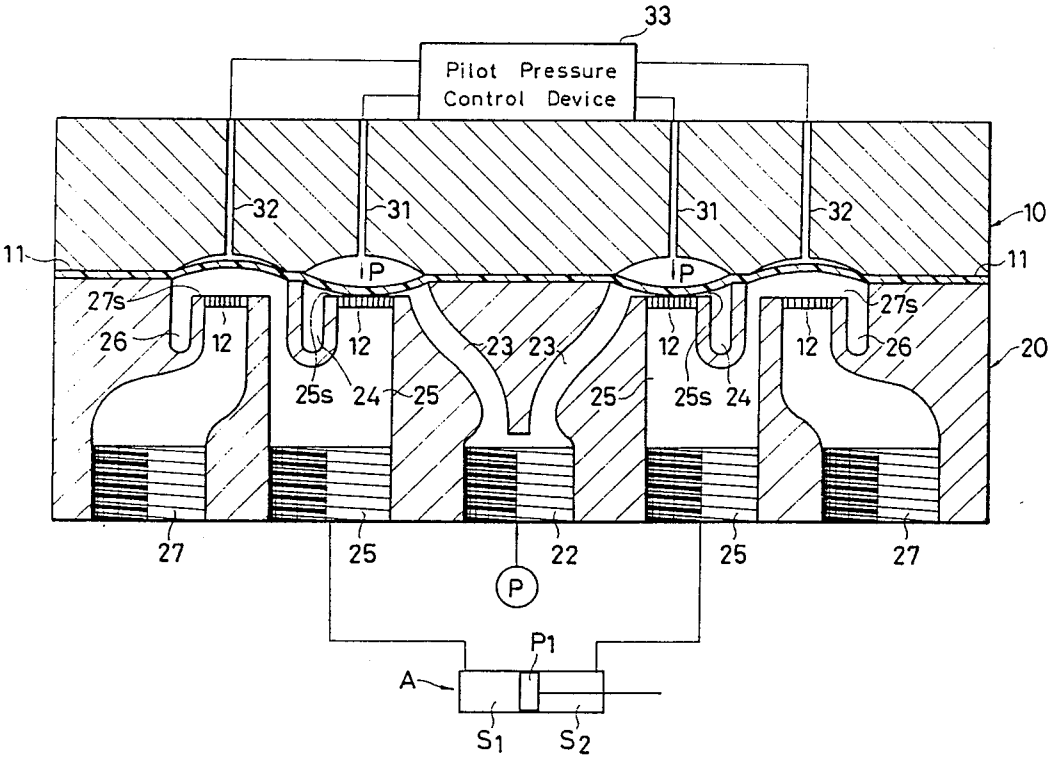
Fig. 12 PRIOR ART

The column 45d which is provided instead of the conventional grids 12 (FIG. 9) comes into contact with the diaphragm centered portion 73 at the flat surface of the top of the column, and accordingly the column can be adapted only to prevent an excess deformation of the diaphragm by properly selecting the value h which is a difference in a surface level between the column and the annular valve seat 45s. Namely, the column 45d contributes to an increase of endurance of the diaphragm 70.

When the pilot pressure passage 64 is subject to the pilot pressure p from the pilot pressure control device 65, the annular valve portion 74 comes into contact with the loading annular passage 47 and the discharging annular passage 48 to break the fluid connection between the loading port 42 and the discharge port 43. On the contrary, if no feed of the pilot pressure to the pilot pressure passages 63 and 64 occurs, the fluid connection is established between the feeding port 41 and the loading port 42 or between the loading port 42 and the discharge port 43. Accordingly, the control of the pilot pressure p makes it possible to feed the pressurized fluid from the pressurized fluid source P1 (FIG. 9) to the loading port 42 or to discharge the fluid in the loading port 42 into the discharge port 43.

In the illustrated embodiment, the loading port 42 is connected to a single pressure chamber 91 of an actuator 90. Accordingly, when the loading port 42 communicates with the feeding port 41 and the loading port 42 is disconnected from the discharge port 43, a piston 93 of the actuator 90 is moved against a compression spring 93. On the contarary, when the loading port 42 is disconnected from the feeding port 41 and is connected to the discharge port 43, the piston 92 is returned to its initial position by the compression spring 93.

In a compact and small directional control valve according to the present invention, it is possible to increase the flow of fluid, particularly between the loading annular passage 47 and the discharging annular passage 48. Namely, since the diameter D of the loading annular passage 47 (and accordingly the discharging annular passage 48) surrounding the separation wall 45 and the annular passage 46 concentric thereto is fairly large, in comparison with the diameter d of the separation wall 45, a large passage sectional area can be obtained even by a slight separation of the annular valve portion 74 of the diaphragm 70 from the loading annular passage 47 (and accordingly the discharging annular passage 48). This ensures a large flow of fluid passing through the fluid passage.

It is possible to combine two valve units each having a single feeding port, a single loading port and a single discharge port, as shown in FIGS. 1–4 in order to actuate a double acting cylinder device in which a piston is selectively moved in opposite directions by the pneumatic pressure. In this alternative, it is possible and preferable to provide a single common feeding port 41, a pair of loading ports 42, and a pair of discharge ports 43 on a single passage block.

Figure 14:
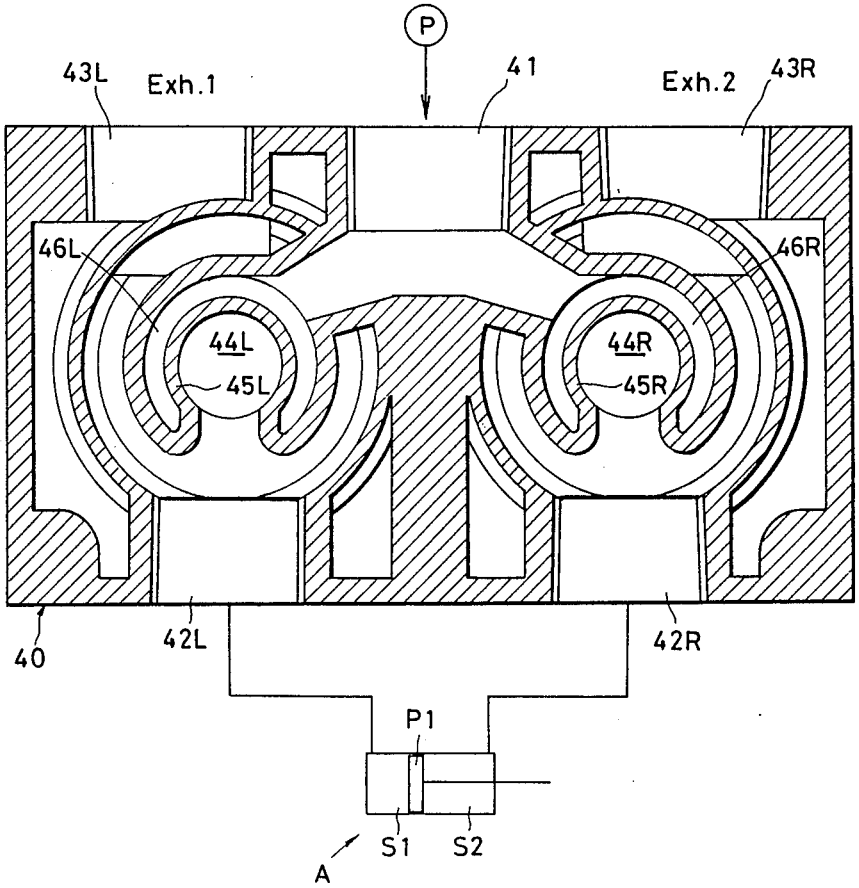
FIG. 14 is a sectional view corresponding to FIG. 4, showing a variant in which two directional control valves shown in FIGS. 1–5 are combined

FIG. 14 is a sectional view of a variant, in which two directional control valves shown in FIGS. 1–5 are functionally connected to each other.

In this variant, the passage block 40 has therein a single feeding port 41 provided in the vicinify of the center portion thereof and a pair of loading ports 42 and a pair of discharge ports 43 on the opposite sides of the feeding port 41. Elements located on the left side are designated with a suffix L and these on the right side are designated with a suffix R, in FIG. 14, respectively.

On the end face of the passage block 40 that is located adjacent to the control block are provided right and left annular passages corresponding to the center holes 44 and the separation walls 46, similarly to the first embodiment mentioned above. Between the passage block 40 and the control block 60 (FIG. 1) put on the passage block is provided a diaphragm 70 (FIG. 1) held there between, similarly to the first embodiment. The diaphragm cooperates with the annular passages corresponding to the center holes 44 and the separation walls 45 to provide two valves operable independently of each other, similarly to the afarementioned first embodiment. Namely, the pressurized air fed from the pressurized air source P to the feeding port 41 can be selectively introduced into the pressure chambers S1 and S2 of the actuator A through the right and left loading ports 42R and 42L and the prossurized air in the pressure chambers S1 and S2 can be discharged through the right and left discharge ports 43R and 43L.

The subject of the present invention is not directed to the construction of the pilot pressure control device 65 which controls the pilot pressure of the pilot pressure passages 63 and 64, and, accordingly, the pilot pressure control device 65 used in the present invention can be of any type.

It should be noted that although the ports 41, 42 and 43 are referred to as feeding port, loading port and discharge port in the illustrated embodiment, respectively, the reference is only for clarification of the invention. The invention can be widely applied to a directional control valve in which the port 42 is selectively connected to the port 41 or the port 43 or is simultaneously connected to both the ports 41 and 43.

Figure 6:
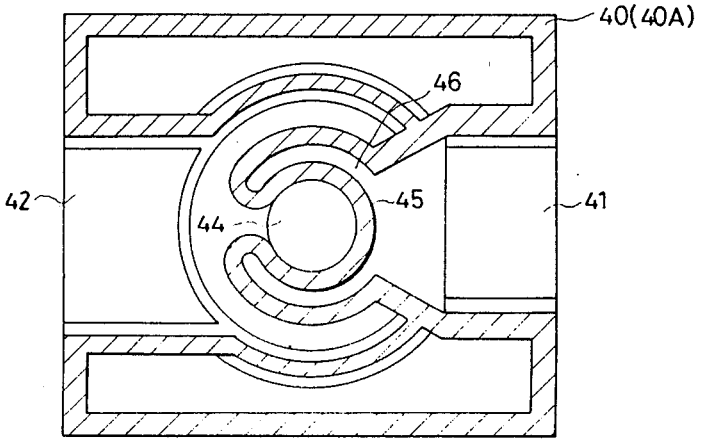
FIGS. 6 and 7 are sectional views showing a different embodiment of the present invention.
Figure 6:
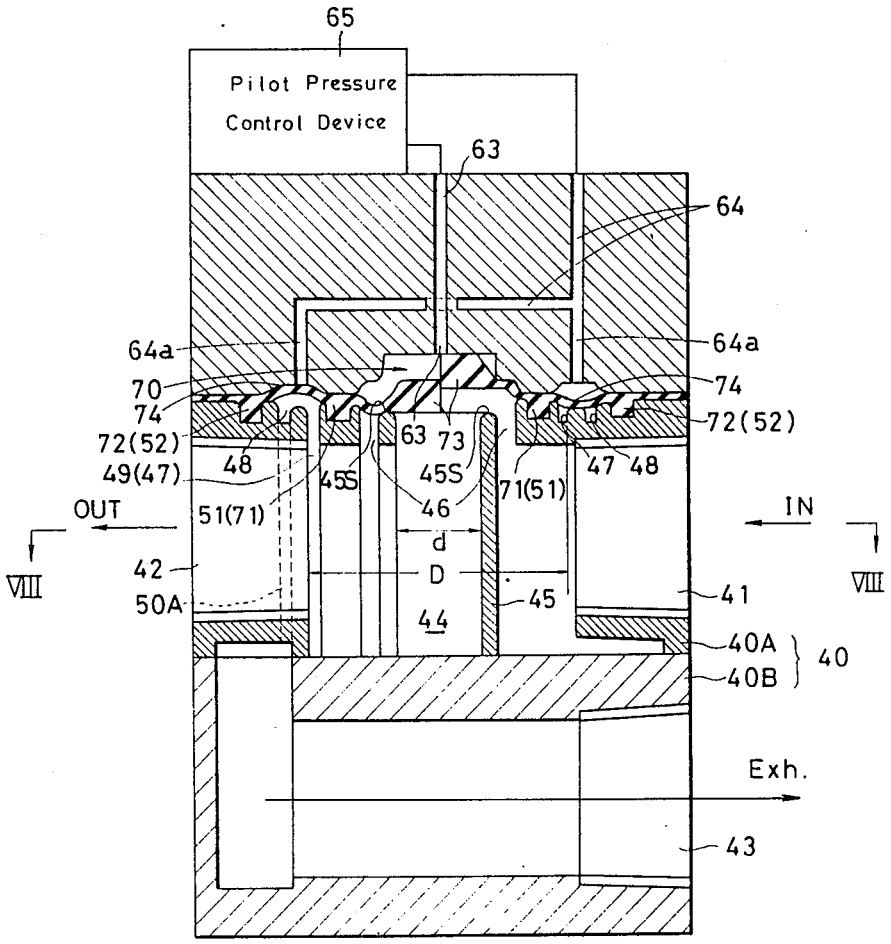
Figure 7:
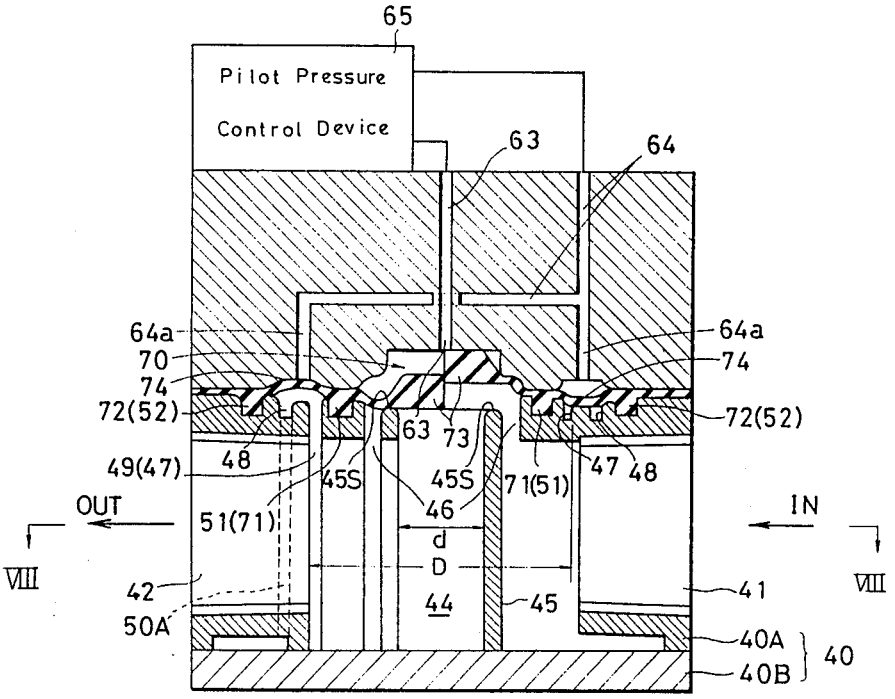
Figure 13:
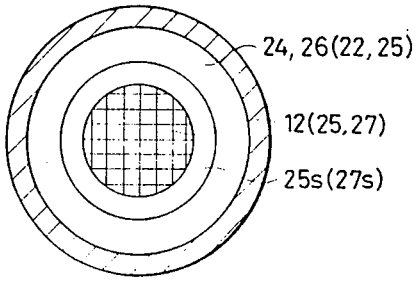
Fig - 13 PRIOR ART
FIG. 13 is a sectional view taken along the line XIII–XIII in FIG. 9.

FIGS. 6–8 show a modified embodiment of the present invention, in which the valve can be selectively used as a three-way valve or as a two-way valve by exchanging an element thereof.

In the embodiment shown in FIGS. 6–8, the passage block 40 is composed of a main block 40A and a discharge block (additional block element) 40B, as shown in FIG. 6 or is composed of a main block 40A and an end plate (additional block element) 40C, as shown in FIG. 7. The valve shown in FIG. 6 is a three-way valve and the valve shown in FIG. 7 is a two-way valve (an opening and closing valve).

The components of the modified embodiment shown in FIGS. 6–8 corresponding to those of the first embodiment shown in FIGS. 1–4 mentioned above are designated with the reference numerals same as those in FIGS. 1–4.

In the modified embodiment, the annular bead 75 is not provided on the diaphragm 70. It is, however also possible to provide the annular bead on the diaphragm similarly to the first embodiment. The direction of the flow of the fluid in FIGS. 6–8 is different from that of the fluid in FIGS. 1–4. Namely. the positional relationship between the feeding port 41 and the loading port 42 in FIGS. 6–8 is opposite to that in FIGS. 1–4.

In FIGS. 6–8, the main block 40A has the feeding port 41 and the loading port 42 which is directly connected to a center hole 44 formed in the main block 40A. A discharge port 43 is formed not in the main block 40A but in the discharge block 40B. Around the center hole 44 is provided through a separation wall 45, a feeding annular passage 46 which is connected to the feeding port 41. The end face of the separation wall 45 adjacent of the control block 60 defines a valve seat 45s.

On the end face of the main block 40A adjacent to the control block 60 are formed a loading annular passage 47 concentric to the center hole 44 and a discharging annular passage (third passage) 48 concentric to the loading annular passage 47. The loading annular passage 47 is connected to the loading port 42 through a connection passage 49, and the discharging annular passage 48 is connected to a passage 50A which opens into the end face of the main block 40A adjacent to the discharge block 40B. The discharge block 40B has a discharge port 43 connected to the connection passage 50A. On the contrary, the end plate 40C has no discharge port and merely closes the connection passage 50A, and accordingly the discharge annular passage 48, as shown in FIG. 7.

On the end face of the main block 40A adjacent to the control block 60 are formed annular bead grooves 51 and 52 for receiving the corresponding annular beads 71 and 72 provided on the diaphragm 70, between the annular passage 46 and the annular passage 47 and outside the annular passage 48, respectively. The diaphragm 70 and the surroundings are same as those in the first embodiment mentioned before.

With the arrangement mentioned above, the directional control valve can be used as a three-way valve in case where the passage block 40 is comprised of the main block 40A and the discharge block 40B. Namely, the pilot pressure p is supplied to the pilot pressure passage 63 to press the center valve portion 73 of the diaphragm 70 against the valve seat 45s in order to break the fluid connection between the feeding port 41 and the loading port 42. In this state, since no pilot pressure acts in the pilot pressure passage 64, the loading port 42 communicates with the discharge port 43.

On the other hand, when the pilot pressure p is supplied to the pilot pressure passage 64, the annular valve portion 74 of the diaphragm 70 comes into contact with the loading annular passage 47 and the discharging annular passage 48 to break the fluid connection between the loading port 42 and the discharge port 43. In this state, the pilot pressure passage 63 is free from the pilot pressure, and, accordingly, the fluid connection between the feeding port 41 and the loading port 42 is established.

As can be seen from the foregoing, according to the present invention, the operation of the pilot pressure control device 65 controls the feed of the pressurized fluid into the loading port 42 from the pressurized fluid source P and to discharge the pressurized fluid in the loading port 42 therefrom through the discharge port 43.

The directional control valve according to the modified embodiment can be also used as a two-way valve in case where the passage block 40 is composed of the main block 40A and the end plate 40C, as shown in FIG. 7. In FIG. 7, since the connection passage 50A, which is connected to the discharge port 43 in the embodiment of FIG. 6, is closed by the end plate 40C, only the feed and release of the pilot pressure into and from the pilot pressure passage 63 controls the break and establishment of the fluid connection between the feeding port 41 and the loading port 42. Namely, the pilot pressure passage 64 does not control the connection between the valve ports 41 and 42. Accordingly, the two-way valve shown in FIG. 7 can be used to merely open and close a fluid passage.

We claim:

1. A diaphragm type of pilot pressure operated directional control valve, comprising a pair of opposed passage block and control block, and a diaphragm held between the passage block and the control block, said passage block having a plurality of passages opening into the end face of the passage block located adjacent to the control block and defining an annular valve seat, said control block having pilot pressure passages opposed to the valve seat and connected to a pilot pressure source to exert a pilot pressure on the face of the diaphragm located adjacent to the control block said diaphragm having a center valve portion and an annular valve portion around the center valve portion, said center valve portion and said annular valve portion being independently subjected to the pilot pressure to selectively control fluid connection between said plurality of passages.

2. A directional control valve according to claim 1, further comprising means for preventing an excess deformation of the diaphragm.

* * * * *